US006981851B2

(12) United States Patent
Lilie

(10) Patent No.: US 6,981,851 B2
(45) Date of Patent: Jan. 3, 2006

(54) PISTON STROKE LIMITING DEVICE FOR A RECIPROCATING COMPRESSOR

(75) Inventor: Dietmar E. Lilie, Joinville (BR)

(73) Assignee: Empresa Brasileira de Compressores S.A.-Embraco, Joinville-Sc (BR)

( * ) Notice: Subject to any disclaimer, the term of this patent is extended or adjusted under 35 U.S.C. 154(b) by 0 days.

(21) Appl. No.: 10/398,500

(22) PCT Filed: Oct. 4, 2001

(86) PCT No.: PCT/BR01/00122

§ 371 (c)(1),
(2), (4) Date: May 23, 2003

(87) PCT Pub. No.: WO02/29251

PCT Pub. Date: Apr. 11, 2002

(65) Prior Publication Data

US 2003/0183073 A1 Oct. 2, 2003

(30) Foreign Application Priority Data

Oct. 5, 2000 (BR) ..... 0004859

(51) Int. Cl.
*F04B 49/035* (2006.01)

(52) U.S. Cl. ..... 417/284; 417/440

(58) Field of Classification Search ..... 417/284, 417/289, 440

See application file for complete search history.

(56) References Cited

U.S. PATENT DOCUMENTS 2,172,751 A * 9/1939 Heinrich ..... 417/440
4,750,871 A 6/1988 Curwen
5,156,005 A 10/1992 Redlich
5,342,176 A 8/1994 Redlich
5,450,521 A 9/1995 Redlich
5,496,153 A 3/1996 Redlich
5,525,045 A * 6/1996 Jang ..... 417/284
5,592,073 A 1/1997 Redlich

FOREIGN PATENT DOCUMENTS

FR 1007910 B1 5/1952
WO WO-00/63556 A1 10/2000

* cited by examiner

*Primary Examiner*—Edward K. Look
*Assistant Examiner*—Michael Leslie
(74) *Attorney, Agent, or Firm*—Darby & Darby

(57) ABSTRACT

A piston stroke limiting device for a reciprocating compressor of the type including a piston (2) reciprocating inside a cylinder (3), which is closed by a cylinder head (4) and defines, between the latter and the top of the piston (2), a compression chamber (5), said device comprising: a driving element (40) provided in one of the parts defined by the piston (2) and the cylinder head (4) and projecting to the inside of the compression chamber (5), in order to touch the other of said parts when the piston (2) surpasses a predetermined nominal position at the end of the compression stroke; and a relief valve (60), which is selectively displaced from a closed condition, in which it is seated on a respective valve seat (51) defined in a relief passage (50) communicating the compression chamber (5) with a region of the compressor subject to a substantially lower operational pressure, to an open condition, by action of the driving element (40), when the piston (2) surpasses said predetermined nominal position at the end of the compression stroke.

24 Claims, 1 Drawing Sheet

PISTON STROKE LIMITING DEVICE FOR A RECIPROCATING COMPRESSOR

CROSS REFERENCE TO PRIOR APPLICATIONS

This is a U.S. national phase application under 35 U.S.C. §371 of International Patent Application No. PCT/BR01/00122 filed Oct. 4, 2001, and claims the benefit of Brazilian Application No. PI 0004859-3, filed Oct. 5, 2000. The International Application was published in English on Apr. 11, 2002 as International Publication No. WO 02/29251 A1 under PCT Article 21(2).

FIELD OF THE INVENTION

The present invention refers to a piston stroke limiting device for a reciprocating compressor, particularly of the type driven by a linear motor and used in small refrigerating appliances, such as refrigerators, freezers, water fountains, etc.

BACKGROUND OF THE INVENTION

In the reciprocating compressors with a linear motor, the gas compression mechanism occurs by the axial movement of approximation and spacing of a piston inside a cylinder, in relation to a cylinder head, which is mounted to an end of the cylinder and in which are positioned suction and discharge valves for controlling the gas inlet and gas outlet in the cylinder.

The piston is driven by an actuator, which carries a magnetic component driven by a linear motor. The piston is connected to a resonant spring and forms with the latter and with the magnetic component the resonant assembly of the compressor. This resonant assembly driven by the linear motor has the function of performing a linear reciprocating movement, making the movement of the piston inside the cylinder exert a compression action on the gas admitted by the suction valve, until said gas is discharged through the discharge valve to the high pressure side of the refrigeration system to which the compressor is mounted.

Variations in the operating conditions of the compressor, or variations in the voltage supply thereof may cause the resonant assembly to be displaced beyond a certain predetermined limit, from which the gas mass of the dead compression volume still existing in the compression chamber begins to actuate as an extra impeller to the piston, increasing the amplitude of its operating cycle, and making the piston top collide with the cylinder head, causing damages to the compressor.

Several forms of controlling the amplitude of the piston stroke have already been presented, either electronic (U.S. Pat. Nos. 5,156,005; 5,342,176; 5,496,153; 5,450,521; 5,592,073), which control the current supplied to the motor as a function of the piston position, or mechanical (usually employed in Stirling machines), such as the inclusion of relief gas channels, or mechanical or pneumatic springs. Electronic commands, which are able to precisely control the position of the piston, are extremely expensive, besides presenting an inertia that is inherent to the system, as it occurs with the mechanical solutions. Such inertia allows the occurrence of occasional impacts.

SUMMARY OF THE INVENTION

Thus, it is an object of the present invention to provide a piston stroke limiting device for a reciprocating compressor, particularly of the type driven by a linear motor, which device, at the end of the compression stroke, minimizes the impelling effects on the piston resulting from the gas mass in the compression chamber that does not reach the discharge chamber at the end of compression.

This and other objects are achieved by a piston stroke limiting device for a reciprocating compressor, said compressor including a piston reciprocating inside a cylinder, which is closed by a cylinder head and defines, between the latter and the top of the piston, a compression chamber, said device comprising: a driving element, which is provided in one of the parts defined by the piston and the cylinder head, and which projects to the inside of the compression chamber, in order to touch the other of said parts when the piston surpasses a predetermined nominal position at the end of the compression stroke; at least one relief passage, which is provided with a valve seat and disposed in one of the parts defined by the piston and the cylinder head, communicating the compression chamber with a region of the compressor that is subject to a substantially lower operational pressure; and a relief valve, which is constantly forced to a closed condition, in which it is seated on the respective valve seat, in order to be selectively displaced to an open condition by action of the driving element, when the piston surpasses said predetermined nominal position at the end of the compression stroke.

BRIEF DESCRIPTION OF THE DRAWINGS

The invention will be described below, with reference to the attached drawings, in which.

DESCRIPTION OF THE ILLUSTRATED EMBODIMENTS

Figure 1:
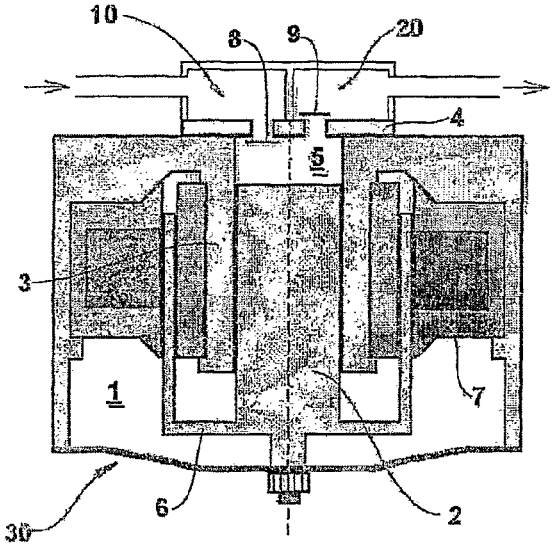
FIG.1 PRIOR ART
FIG. 1 is a schematic longitudinal diametrical sectional view of part of a reciprocating compressor with a linear motor, constructed according to the prior art.

The present invention will be described in relation to a reciprocating compressor used in refrigeration systems and driven by a linear motor, this motor-compressor assembly being mounted inside a hermetic shell 1 connecting the compressor to, for example, a refrigeration system. In the illustrated constructions, the compressor presents a piston 2 provided inside a cylinder 3, which is closed by a cylinder head 4 and defines, between the latter and the piston top, a compression chamber 5.

In the illustrated constructions in which the compressor is of the type driven by a linear motor, the piston 2 is coupled to an actuating means 6, which is generally tubular, external to the cylinder 3, and carries a magnetic component 7, which is axially impelled by energization of the linear motor. The spacing and approximation movements of the piston 2 inside the cylinder 3 in relation to the cylinder head 4 determines, respectively, the suction operation and the discharge operation of the gas in the compression cycle of the compressor. The compression stroke end condition of the piston is defined by a predetermined nominal position of the piston inside the compressor chamber 5, which position, indicated in FIGS. 2–4 by a dashed line, if surpassed, causes the previously mentioned deficiencies.

According to the illustration in FIG. 1, in the cylinder head 4 is provided a suction orifice, in which is mounted a suction valve 8, selectively communicating the inside of the compression chamber 5 with the inside of a suction chamber 10, and a discharge orifice, in which is mounted a discharge valve 9, selectively communicating the inside of the compression chamber 5 with the discharge chamber 20, said suction and discharge valves 8, 9 controlling the gas inlet and gas outlet in the cylinder 3.

The piston 2 is connected to a resonant spring 30, forming therewith and with the magnetic component 7, a resonant assembly.

According to the present invention, in order to minimize the effects resulting from the impelling action of the non-compressed gas to the discharge chamber 20 at the end of compression, the present invention has a piston stroke limiting device for a reciprocating compressor, particularly of the type driven by a linear motor, said device comprising a driving element 40, provided in one of the parts defined by the piston 2 and the cylinder head 4, and projecting to the inside of the compression chamber 5, in order to touch the other of said parts when the piston 2 surpasses a predetermined nominal position at the end of the compression stroke; at least one relief passage 50, which is provided with a valve seat 51, and disposed in one of the parts defined by the piston 2 and the cylinder head 4, communicating the compression chamber 5 with a region of the compressor subject to a lower operational pressure, such as for example, the suction chamber 10, or the inside of the hermetic shell 1 of the compressor; and a relief valve 60, which is constantly forced to a closed condition, for instance by a spring 70, which is seated on the part of the piston 2 or the cylinder head 4 that defines the valve seat 51, and which is seated, at said closed condition, on said valve seat 51, in order to be selectively displaced to a open condition, by action of the driving element 40, when the piston 2 surpasses said predetermined nominal position at the end of the compression stroke. Although a construction has been described and illustrated, in which the piston stroke limiting device has only one driving element 40 actuating on a respective relief valve 60, the concept presented herein foresees the provision of a plurality of driving elements and the respective relief valves.

According to an illustrated constructive form of the present invention, the driving element 40 presents an extension corresponding to the distance between the stroke end predetermined nominal position of the piston 2 and the cylinder head 4.

According to an illustrated constructive form of the present invention, the piston 2 carries on the top thereof the driving element 40.

Figure 2:
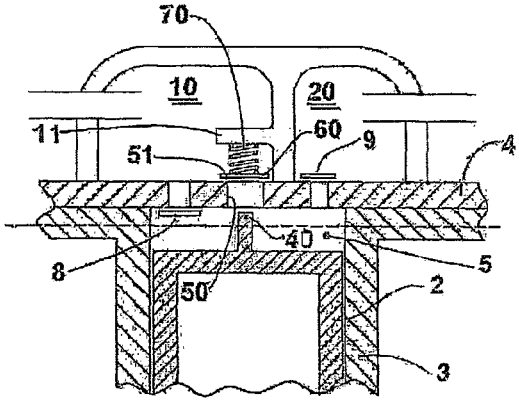
FIG. 2 is a schematic longitudinal diametrical sectional view of part of a reciprocating compressor with a linear motor, constructed according to a first way of carrying out the present invention.

In a constructive option illustrated in FIG. 2, the piston 2 affixes, for example incorporating in a single piece, the driving element 40. In this construction, the relief passage 50 is provided in the cylinder head 4, the valve seat 51 being defined on a face of said cylinder head 4 turned to the inside of the suction chamber 20. In this construction, the relief valve 60 is mounted inside said suction chamber 10, from a seating surface 11 provided inside said suction chamber 10 and which affixes the spring 70 that is constantly forcing the relief valve 60 to a closed position of the relief passage 50. In the constructive option illustrated in FIG. 2, the relief valve 60 is in the form of a flat disc.

Figure 3:
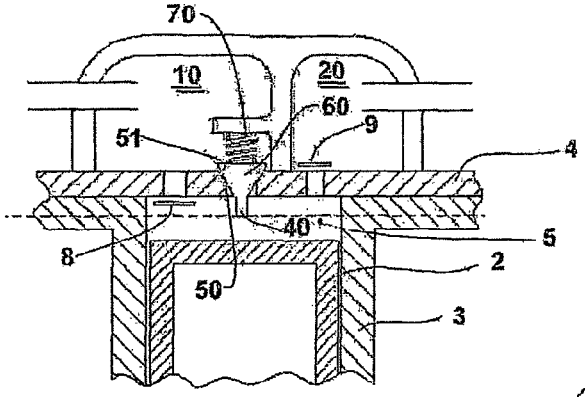
FIG. 3 is a schematic longitudinal diametrical sectional view of part of a reciprocating compressor with a linear motor, constructed according to a second way of carrying out the present invention.
Figure 4:
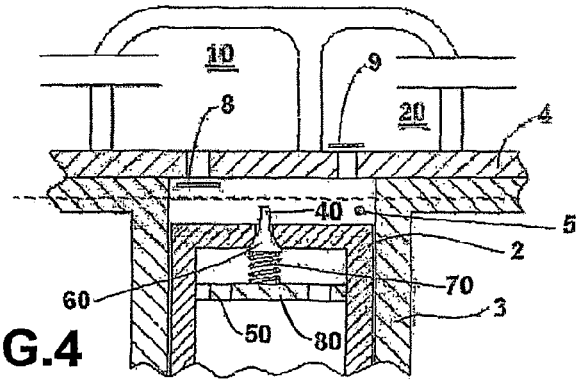
FIG. 4 is a schematic longitudinal diametrical sectional view of part of a reciprocating compressor with a linear motor, constructed according to a third way of carrying out the present invention.

According to the illustrations of FIGS. 3 and 4, the driving element 40 is affixed, for instance incorporated to the relief valve 60, having its axis coinciding with the axis of said relief valve 60, and coinciding with the axis of piston 2. In these constructions, the relief valve 60 is in the form of a substantially tapered body.

In the construction illustrated in FIG. 3, the relief valve 60 is mounted inside the suction chamber 10, on a seating support 11 thereof, and the relief passage 50 is defined in this construction in the cylinder head 4.

In the illustrated construction of FIG. 4, the relief valve 60 carrying the driving element 40 is mounted, through the spring 70, on a support 80, which is affixed or incorporated inside the piston 2, spaced from the top thereof, by a certain predetermined distance, in the construction therein, the relief passage 50 that defines the valve seat 51 for the relief valve 50 is provided on the top of the piston 2. In this construction, the relief valve 60 seats, in its closed condition, on a valve seat 51, defined on the top of the piston 2 top and opened to the inside of the hermetic shell 1.

The support 80 further presents at least one another relief passage 50, communicating the inside of the compression chamber 5 with the inside of the shell 1, when the relief valve is opened against the action of the spring 70, in the conditions where the piston 2 surpasses said predetermined nominal position at the compression stroke end.

What is claimed is:

1. A piston stroke limiting device for a reciprocating compressor, said compressor including a piston reciprocating inside a cylinder, which is closed by a cylinder head and which defines between the cylinder head and a top of the piston a compression chamber, comprising:

a driving element provided in the cylinder head and which projects to an inside of the compression chamber, in order to touch the piston when the piston surpasses a predetermined nominal position at the end of a compression stroke;

at least one relief passage provided with a valve seat and disposed in one of the parts defined by the piston and the cylinder head, communicating the compression chamber with a region of the compressor subject to a substantially lower operational pressure; and a relief valve, constantly forced to a closed condition, which is seated on a respective valve seat in order to be selectively displaced to an open condition by action of the driving element when the piston surpasses said predetermined nominal position at the end of the compression stroke.

2. The device, according to claim 1, further comprising at least one relief passage which is opened to one of the parts defined by the inside of a hermetic shell of the compressor and by a suction chamber of said compressor.

3. The device, according to claim 1, wherein the relief valve is constantly forced to a closed condition by a spring seated on the part of the piston or the cylinder head that defines the valve seat.

4. The device, according to claim 1, wherein the driving element projects to the inside of the compression chamber by an extension corresponding to the distance between the stroke end predetermined nominal position of the piston and the cylinder head.

5. The device, according to claim 1, wherein the driving element is affixed to the relief valve.

6. The device, according to claim 1, wherein the driving element presents an axis coinciding with that of the relief valve.

7. The device, according to claim 1, wherein the relief valve is in the form of a substantially tapered body.

8. The device, according to claim 1, wherein the relief valve is in the form of a flat disc.

9. The device, according to claim 1, wherein the driving element presents an axis coinciding with that of the piston.

10. The device, according to claim 1, wherein the relief valve is mounted inside a suction chamber and the relief passage is defined in the cylinder head.

11. The device, according to claim 1, wherein said predetermined nominal position is a normal end position of the piston.

12. A piston stroke limiting device for a reciprocating compressor, said compressor including a piston reciprocating inside a cylinder, which is closed by a cylinder head and which defines between the cylinder head and a top of the piston a compression chamber, comprising:

a driving element provided in one of the parts defined by the piston and the cylinder head and which projects to an inside of the compression chamber, in order to touch the other of said parts when the piston surpasses a predetermined nominal position at the end of a compression stroke;

at least one relief passage provided with a valve seat and disposed in one of the parts defined by the piston and the cylinder head, communicating the compression chamber with a region of the compressor subject to a substantially lower operational pressure;

a relief valve, constantly forced to a closed condition and which is seated on a respective valve seat in order to be selectively displaced to an open condition by action of the driving element when the piston surpasses said predetermined nominal position at the end of the compression stroke; and wherein the driving element and the relief valve are formed separately.

13. A piston stroke limiting device for a reciprocating compressor, said compressor including a piston reciprocating inside a cylinder, which is closed by a cylinder head and which defines between the cylinder head and a top of the piston a compression chamber, comprising:

a driving element provided in one of the parts defined by the piston and the cylinder head and which projects to an inside of the compression chamber, in order to touch the other of said parts when the piston surpasses a predetermined nominal position at the end of a compression stroke;

at least one relief passage provided with a valve seat and disposed in the cylinder head, communicating the compression chamber with a region of the compressor subject to a substantially lower operational pressure; and a relief valve mounted inside a suction chamber, constantly forced to a closed condition, which is seated on a respective valve seat, in order to be selectively displaced to an open condition by action of the driving element when the piston surpasses said predetermined nominal position at the end of the compression stroke.

14. The device, according to claim 13, wherein the relief valve is constantly forced to a closed condition by a spring seated on a part of the piston or the cylinder head that defines the valve seat.

15. The device, according to claim 13, wherein the driving element projects to the inside of the compression chamber by an extension corresponding to the distance between the stroke end predetermined nominal position of the piston and the cylinder head.

16. The device according to claim 13, wherein the piston carries, on an upper portion, the driving element.

17. The device, according to claim 13, wherein the piston incorporates the driving element.

18. The device, according to claim 13, wherein the relief valve is in the form of a flat disc.

19. The device, according to claim 13, wherein the driving element presents an axis coinciding with that of the piston.

20. The device, according to claim 13, wherein the driving element and the relief valve are formed separately.

21. The device, according to claim 13, wherein said predetermined nominal position is a normal end position of the piston.

22. The device, according to claim 13, wherein the driving element presents an axis coinciding with that of the relief valve.

23. The device, according to claim 13, wherein the relief valve is in the form of a substantially tapered body.

24. A piston stroke limiting device for a reciprocating compressor, said compressor including a piston reciprocating inside a cylinder, which is closed by a cylinder head and which defines between a latter and a top of the piston a compression chamber, comprising:

a driving element provided in the piston which projects to an inside of the compression chamber, in order to touch the cylinder head when the piston surpasses a predetermined nominal position at the end of a compression stroke;

at least one relief passage provided with a valve seat and disposed internal to the piston;

a relief valve, constantly forced to a closed condition, which is seated on a respective valve seat, in order to be selectively displaced to an open condition by action of the driving element when the piston surpasses said predetermined nominal position at the end of the compression stroke;

a support disposed inside the piston and consisting essentially of a solid piece having at least one relief passage which communicates with an interior space of the piston, defined by a first region containing the relief valve and the support, and a second region defined by a remainder of the interior of the piston; and wherein the relief valve is mounted to the support inside the piston, in order to be seated on the valve seat opened to the inside of a hermetic shell of the compressor.

* * * * *